US006237358B1

(12) United States Patent
Kondo et al.

(10) Patent No.: US 6,237,358 B1
(45) Date of Patent: May 29, 2001

(54) REFRIGERATION SYSTEM

(75) Inventors: Isao Kondo; Akitoshi Ueno; Takenori Mezaki, all of Osaka (JP)

(73) Assignee: Daikin Industries, Ltd. (JP)

( * ) Notice: Subject to any disclaimer, the term of this patent is extended or adjusted under 35 U.S.C. 154(b) by 0 days.

(21) Appl. No.: 09/622,795

(22) PCT Filed: Dec. 14, 1999

(86) PCT No.: PCT/JP99/07024

§ 371 Date: Aug. 23, 2000

§ 102(e) Date: Aug. 23, 2000

(87) PCT Pub. No.: WO00/39509

PCT Pub. Date: Jul. 6, 2000

(30) Foreign Application Priority Data

Dec. 25, 1998 (JP) ..... 10-369538

(51) Int. Cl.[7] ..... F25B 7/00
(52) U.S. Cl. ..... 62/335
(58) Field of Search ..... 62/335

(56) References Cited

U.S. PATENT DOCUMENTS

Re. 34,030 * 8/1992 Scherer ..... 62/238.3
4,028,079 * 6/1977 Scheibel ..... 62/335
5,170,639 * 12/1992 Datta ..... 62/335
5,687,579 * 11/1997 Vaynberg ..... 62/335

FOREIGN PATENT DOCUMENTS 9-210515 8/1997 (JP) .

* cited by examiner

*Primary Examiner*—Corrine McDermott
*Assistant Examiner*—Mohammad M Ali
(74) *Attorney, Agent, or Firm*—Nixon Peabody LLP; Donald R. Studebaker

(57) ABSTRACT

A first refrigeration circuit (1) for a refrigerating apparatus (6) which is formed into a two-stage cascade refrigerating cycle by establishing connection between a high temperature-side refrigerant circuit (3) and a low temperature-side refrigerant circuit (4) through a first refrigerant heat exchanger (5A), a second refrigeration circuit (2) which is formed into a refrigerating cycle different from that of the first refrigeration circuit (1), and a second refrigerant heat exchanger (5B) connected to the low temperature-side refrigerant circuit (4) are provided. The second refrigerant heat exchanger (5B) is connected, through connection piping lines (41, 42), to a liquid piping line (36*a*) and a suction-side gas piping line (36*b*) of the second refrigeration circuit (2). First switching means (43, 44) are disposed for selective circulation of a refrigerant of the second refrigeration circuit (2) to the second refrigerant heat exchanger (5B) through the connection piping lines (41, 42), whereby, even when a heat source equipment (11) stops operating in a two-stage cascade refrigerating-cycle refrigeration system applied to a showcase or the like, it becomes possible to achieve continuation of refrigeration operation.

6 Claims, 7 Drawing Sheets

REFRIGERATION SYSTEM

TECHNICAL FIELD

The present invention relates to a refrigeration system and more particularly to a technique for continuation of refrigeration operation in the event that a heat source equipment stops in a two-stage cascade refrigerating cycle refrigeration system.

BACKGROUND ART

As disclosed in Japanese Unexamined Patent Gazette No. H09-210515, there is a conventional refrigeration system which is formed into a two-stage cascade refrigerating cycle of the vapor compression type by connecting together a high temperature-side refrigerant circuit and a low temperature-side refrigerant circuit through a refrigerant heat exchanger. More specifically, the high temperature-side refrigerant circuit, on the one hand, comprises a closed circuit formed by sequential connection, established by refrigerant piping, of a compressor, a heat source-side heat exchanger, an expansion valve, and an evaporation portion of a refrigerant heat exchanger. On the other hand, the low temperature-side refrigerant circuit comprises a closed circuit formed by sequential connection, established by refrigerant piping, of a compressor, a condensation portion of the refrigerant heat exchanger, an expansion valve, and an application-side heat exchanger.

Such a two-stage cascade refrigerating cycle refrigeration system finds applications in refrigerating apparatus such as showcases for foods or the like installed at stores (e.g., super markets and convenience stores). Defined in such a showcase are a display space for frozen foods in the showcase chamber and an air passage for the circulation of air with the display space. The application-side heat exchanger, which is disposed in the air passage, is able to provide a supply of air into the showcase chamber with the aid of an air blower.

During the operation of the showcase, refrigerants are circulated in the high temperature-side refrigerant circuit and in the low temperature-side refrigerant circuit, wherein heat exchange is carried out between the refrigerants of these two refrigerant circuits in the refrigerant heat exchanger. With regard to the low temperature-side refrigerant circuit, a refrigerant discharged out of the compressor condenses in the refrigerant heat exchanger, decompresses in the expansion valve, and thereafter evaporates by heat exchange with air flowing through the air passage in the application-side heat exchanger in the showcase, whereby the air is cooled. Then, the cooled air is supplied, through the air passage, into the display space in the showcase chamber. In this way, foods are preserved at a predefined low temperature to maintain their freshness.

However, in such a conventional showcase constructed in the way described above, the operation will be brought into a stop when there occurs a failure in some equipment on the heat source side (e.g., the compressor), even though the application-side equipments are normally operating. There are some possible means of coping with such stoppage, one of which is to transfer the goods to another showcase that remains in operation. This, however, results in an increase in the load of refrigerating/cooling, therefore producing the problem of making it impossible to maintain the quality of goods at a satisfactory level. Particularly, in the case a freezing showcase stops, this produces the problem that the stored goods cannot be preserved at a satisfactory level of quality even when transferred into a cold storage showcase.

Bearing in mind the above-described problems, the present invention was made. Accordingly, an object of the present invention is to maintain the quality of goods by achieving continuation of refrigeration operation even when a heat source-side equipment stops in a two-stage cascade refrigerating cycle refrigeration system applied to a showcase or the like.

DISCLOSURE OF INVENTION

In accordance with the present invention, even when in a two-stage cascade refrigerating cycle refrigeration system an equipment on the heat source side stops, a high temperature-side refrigerant circuit will be formed by making utilization of a refrigeration circuit provided in air conditioning apparatus or the like, for the achievement of continuation of two-stage cascade refrigerating cycle operation.

More specifically, the present invention provides first solving means comprising a first refrigeration circuit (1) for a refrigerating apparatus (6) which is formed into a two-stage cascade refrigerating cycle by establishing connection between a high temperature-side refrigerant circuit (3) and a low temperature-side refrigerant circuit (4) through a first refrigerant heat exchanger (5A), a second refrigeration circuit (2) which is formed into a refrigerating cycle different from that of the first refrigeration circuit (1), and a second refrigerant heat exchanger (5B) connected to the low temperature-side refrigerant circuit (4), wherein the second refrigerant heat exchanger (5B) is connected, through connection piping lines (41, 42), to a liquid piping line **(36*a*) and a suction-side gas piping line (36*b*) of the second refrigeration circuit (2) and wherein first switching means (43, 44) are provided for selective circulation of a refrigerant of the second refrigeration circuit (2) to the second refrigerant heat exchanger (5B) through the connection piping lines (41, 42)**.

Further, the present invention provides second solving means according to the first solving means, wherein the second refrigerant heat exchanger (5B) has a condensation portion (21B) connected serially to a downstream side of a condensation portion (21A) of the first refrigerant heat exchanger (5A), wherein the low temperature-side refrigerant circuit (4) has a bypass passage (26) so that refrigerant bypasses the second refrigerant heat exchanger (5B) to flow from the first refrigerant heat exchanger (5A) into an application-side heat exchanger (24), and wherein the low temperature-side refrigerant circuit (4) has second switching means (27, 28) for switching between a first mode in which refrigerant passes through the bypass passage (26) to circulate in the condensation portion (21A) of the first refrigerant heat exchanger (5A) and the application-side heat exchanger (24) and a second mode in which the refrigerant circulates in the condensation portions (21A, 21B) of both of the refrigerant heat exchangers (5A, 5B) and the application-side heat exchanger (24).

The present invention provides third solving means according to the first solving means, wherein the second refrigeration circuit (2) is a refrigeration circuit for air conditioning apparatus.

The present invention provides fourth solving means according to the first solving means, wherein the first refrigerant heat exchanger (5A) is able to provide a supply of air to the chamber inside of the refrigerating apparatus (6) by means of an air blower. The present invention provides fifth solving means according to the first or fourth solving means, wherein the second refrigerant heat exchanger (5B) is able to provide a supply of air to the chamber inside of the refrigerating apparatus (6) by means of an air blower.

The present invention provides sixth solving means according to the first solving means, wherein the second refrigeration circuit (2) is formed into a single-stage refrigerating cycle.

In the first solving means, during normal operation, the chamber inside of refrigerating apparatus such as the freezing showcase (6) is maintained at a predetermined low temperature by two-stage cascade refrigerating cycle running operations by the first refrigerant heat exchanger (5A) in the first refrigeration circuit (1). On the other hand, when the heat source equipment (11) employed in the high temperature-side refrigerant circuit (3) of the first refrigeration circuit (1) stops operating due to failure or the like, it is possible to flow a refrigerant of the second refrigeration circuit (2) which is formed into, for example, a single-stage refrigerating cycle into the second refrigerant heat exchanger (5B) through the connection piping lines (41, 42) by means of the first switching means (43, 44). This allows the heat source equipment (31) of the second refrigeration circuit (2) and the second refrigerant heat exchanger (5B) to together form a high temperature-side refrigerant circuit, whereby the operation on the low stage side can be continued in the low temperature-side refrigerant circuit (4) in the same manner as in the normal operation state.

Further, in the second solving means, when the second switching means (27, 28) are set to the first mode, in the low temperature-side refrigerant circuit (4) refrigerant passes through the bypass passage (26) to circulate between the condensation portion (21A) of the first refrigerant heat exchanger (5A) and the application-side heat exchanger (24). Because of this, it is possible to perform two-stage cascade refrigerating cycle running operations through the use of the high temperature-side refrigerant circuit (3) of the first refrigeration circuit (1).

On the other hand, when the second switching means (27, 28) are set to the second mode, in the low temperature-side refrigerant circuit (4) refrigerant circulates in the condensation portions (21A, 21B) of both of the refrigerant heat exchangers (5A, 5B) and the application-side heat exchanger (24). Because of this, when there is provided a supply of refrigerant from the second refrigeration circuit (2) to the second refrigerant heat exchanger (5B) while letting a refrigerant circulate in the high temperature-side refrigerant circuit (3), this makes it possible to allow a refrigerant to undergo heat exchange at both the first and second refrigerant heat exchangers (5A, 5B) in the low temperature-side refrigerant circuit (4), thereby enhancing the condensation capacity. As a result, the degree of subcool of the refrigerant increases. Moreover, in the second mode, when the heat source equipment (11) of the high temperature-side refrigerant circuit (3) stops operating, a supply of refrigerant to the second refrigerant heat exchanger (5B) from the second refrigeration circuit (2) makes it possible to achieve the two-stage cascade refrigerating cycle running operations as in the normal operation.

Furthermore, in the third solving means, the refrigeration circuit (2) for air conditioning apparatus installed in various stores such as a supermarket and a convenience store is utilized to enable a refrigerating apparatus such as the showcase (6) to continue operating.

Further, in the fourth solving means, for example, even when the compressor (22) of the low temperature-side refrigerant circuit (4) stops operating, if an air blower for the first refrigerant heat exchanger (5A) is operated while letting refrigerant circulate only in the high temperature-side refrigerant circuit (3), this achieves heat exchange between the refrigerant and air at the first refrigerant heat exchanger (5A) to generate low temperature air. This low temperature air is then supplied to the chamber inside of the showcase (6) or the like.

Furthermore, in the fifth solving means, when the compressor (22) of the low temperature-side refrigerant circuit (4) stops operating, if an air blower for the second refrigerant heat exchanger (5B) is operated while letting a refrigerant of the second refrigeration circuit (2) flow into the evaporation portion (13B) of the second refrigerant heat exchanger (5B), this achieves heat exchange between the refrigerant and air at the second refrigerant heat exchanger (5B) to generate low temperature air. This low temperature air is then supplied to the chamber inside of the showcase (6) or the like.

In accordance with the first solving means, at the time when the heat source equipment (11) in use by the high temperature-side refrigerant circuit (3) of the first refrigeration circuit (1) stops operating due to failure or the like, it is possible that the heat source equipment (31) of the second refrigeration circuit (2) of, for example, a single-stage refrigerating cycle and the second refrigerant heat exchanger (5B) together form a makeshift high temperature-side refrigerant circuit to provide a supply of refrigerant to the second refrigerant heat exchanger (5B), whereby two-stage cascade refrigerating cycle running operations can be continued. Accordingly, the freezing showcase (6) or the like can continue its operation. Therefore, without having to transfer foods or the like displayed in the freezing showcase (6) to another showcase, it is possible to temporarily maintain the quality. Moreover, since there is no need to transfer foods or the like to a different showcase, this prevents the load thereof from increasing.

Further, in accordance with the second solving means, if, by setting the second switching means (27, 28) to the second mode, there is provided a supply of refrigerant from the second refrigeration circuit (2) to the second refrigerant heat exchanger (5B) while letting a refrigerant circulate in the high temperature-side refrigerant circuit (3), this increases the degree of subcool of the refrigerant of the low temperature-side refrigerant circuit (4), therefore making it possible to temporarily enhance the refrigerating capacity of the refrigeration system. This will prove to be effective when performing rapid refrigeration after the temperature of the application-side heat exchanger (24) has increased because of, for example, the execution of a defrosting operation. A typical conventional way of preparing for the load during rapid refrigeration is to use equipment having a sufficient capacity, which however results in waste of equipment capacity during normal operation. In accordance with the present solving means, such waste can be avoided, whereby system down-sizing can be achieved.

Furthermore, in accordance with the third solving means, even when the heat source equipment (11) for the freezing showcase (6) or the like at, for example, a convenience store stops operating, it is possible to temporarily maintain the quality of foods or the like displayed in the showcase (6) by making utilization of the second refrigeration circuit (2) for air conditioning apparatus.

Further, in accordance with the fourth and fifth solving means, even when the compressor (22) of the low temperature-side refrigerant circuit (4) stops operating, it is arranged such that single-stage refrigerating cycle refrigeration operations can be carried out by making utilization of the first refrigerant heat exchanger (5A) and the second refrigerant heat exchanger (5B), as a result of which arrangement, although the temperature of the chamber inside of the freezing showcase (6) or the like somewhat increases (since the operation takes place only at the high-stage side), it becomes possible to prevent foods or the like from rapidly dropping in their quality.

BEST MODE FOR CARRYING OUT THE INVENTION

An embodiment of the present invention will be described in detail by making reference to the accompanying drawing figures.

Figure 1:
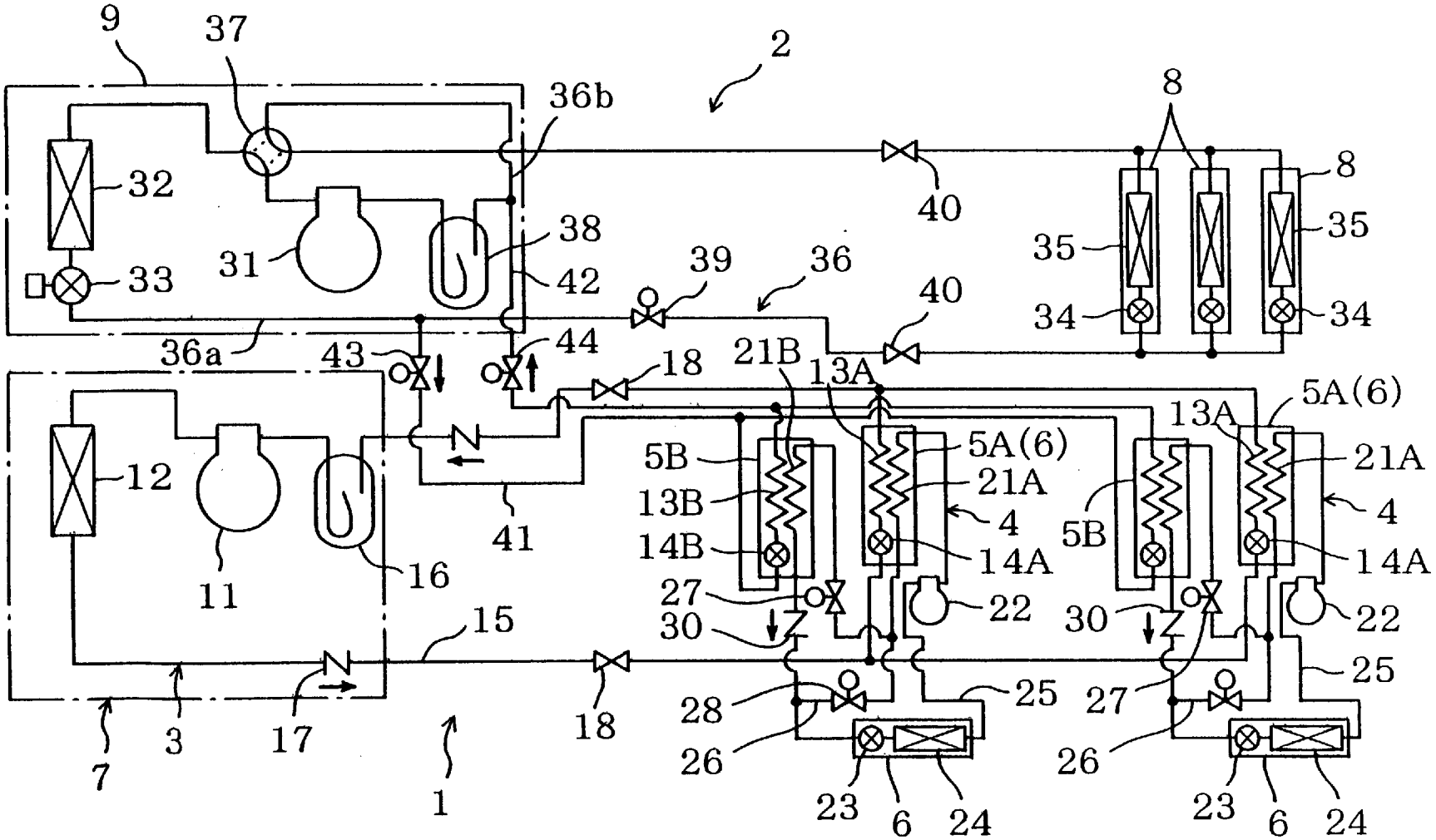
FIG. 1 is a circuit diagram of a refrigeration system according to an embodiment of the present invention.

As shown in FIG. 1, a refrigeration system according to the present embodiment has a first refrigeration circuit (1) and a second refrigeration circuit (2). The first refrigeration circuit (1) is formed into a two-stage cascade refrigeration cycle of the vapor compression type by establishing connection between a high temperature-side refrigerant circuit (3) and a low temperature-side refrigerant circuit (4) through a first refrigerant heat exchanger (5A), whereas the second refrigeration circuit (2) is formed into a single-stage refrigeration cycle of the vapor-compression type. Moreover, the first refrigeration circuit (1) is constituted as a refrigeration circuit for a refrigerating apparatus such as a freezing showcase (6) or the like, whereas the second refrigeration circuit (2) is constituted as a refrigeration circuit for air conditioning apparatus.

The first refrigeration circuit (1) comprises a heat source unit (7) having a compressor (11) and a heat sourceside heat exchanger (12) and a plurality of the first refrigerant heat exchangers (5A) connected in parallel with respect to the heat source unit (7). Each of the first refrigerant heat exchangers (5A) includes an evaporation portion (13A) for the high temperature-side refrigerant circuit (3) and a condensation portion (21A) for the low temperature-side refrigerant circuit (4) which are integrally formed, and an expansion valve (14A) is disposed on the upstream side of the evaporation portion (13).

The high temperature-side refrigerant circuit (3) is formed into a closed circuit by establishing connection of the compressor (11) and the heat source-side heat exchanger (12) of the heat source unit (7) and the expansion valve (14A) and the evaporation portion (13A) on the side of the first refrigerant heat exchanger (5A) by a refrigerant line (15). Further, in the high temperature-side refrigerant circuit (3), the heat source unit (7) includes an accumulator (16) and a check valve (17), and reference numeral (18) indicates a joint of the refrigerant line (15). The low temperature-side refrigerant circuit (4) is formed into a closed circuit by establishing connection of a compressor (22), a condensation portion (21A) of the first refrigerant heat exchanger (5A), an expansion valve (23), and an application-side heat exchanger (24) by a refrigerant line (25).

The second refrigeration circuit (2) is formed into a closed circuit by establishing connection of a compressor (31), an outdoor heat exchanger (32), an outdoor expansion valve (33), an indoor expansion valve (34), and an indoor heat exchanger (35) by a refrigerant line (36). Disposed in the refrigerant line (36) on the discharge side of the compressor (31) is a four-way selector valve (37) operable to switch the direction of refrigerant circulation between the normal cycle for cooling operation and the reverse cycle for heating operation.

The indoor expansion valve (34) and the indoor heat exchanger (35) are provided in an indoor unit (8). Each indoor unit (8) is connected in parallel with respect to an outdoor unit (9) which includes the compressor (31), the outdoor heat exchanger (32), and the expansion valve (33). The outdoor unit (9) further includes an accumulator (38). Moreover, in the second refrigeration circuit (2), reference numeral (39) indicates a solenoid valve and reference numeral (40) indicates a joint of the refrigerant line (36).

On the other hand, second refrigerant heat exchangers (5B) are included in the first refrigeration circuit (1). The second refrigerant heat exchanger (5B) has a condensation portion (21B) connected to the low temperature-side refrigerant circuit (4) and an evaporation portion (13B) connected to the second refrigeration circuit (2). Disposed on the upstream side of the evaporation portion (13B) is an expansion valve (14B).

The evaporation portion (13B) of the second refrigerant heat exchanger (5B) is connected, through connection piping lines (41, 42), to a liquid piping line (36*a*) and a suction-side gas piping line (36*b*) of the second refrigeration circuit (2). Disposed in these connection piping lines (41, 42) are solenoid valves (43, 44) as first switching means for selectively circulating a refrigerant of the second refrigeration circuit (2) to the second refrigerant heat exchanger (5B).

The condensation portion (21B) of the second refrigerant heat exchanger (5B) is serially connected to a downstream side of the condensation portion (21A) of the first refrigerant heat exchanger (5A). Disposed in the low temperature-side refrigerant circuit (4) is a bypass passage (26), wherein refrigerant flows, bypassing the condensation portion (21B) of the second refrigerant heat exchanger (5B), from the condensation portion (21A) of the first refrigerant heat exchanger (5A) into the application-side heat exchanger (24). Further, disposed in the low temperature-side refrigerant circuit (4) are solenoid valves (27, 28) as second switching means for switching between a first mode in which refrigerant passes through the bypass passage (26) to circulate between the condensation portion (21A) of the first refrigerant heat exchanger (5A) and the application-side heat exchanger (24) and a second mode in which refrigerant circulates between the condensation portions (21A, 21B) of the refrigerant heat exchangers (5A, 5B) and the application-side heat exchanger (24). In addition, disposed on the downstream side of the condensation portion (21B) of the second refrigerant heat exchanger (5B) is a check valve (30).

In the present embodiment, in addition to the arrangement that the application-side heat exchanger (24) is disposed in an air passage of the showcase (6), the first refrigerant heat exchanger (5A) is also disposed in the air passage of the showcase (6). These heat exchangers (5A, 24) are constructed so as to supply cooled air to a display space in the showcase (6) for foods or like with the aid of an air blower not shown in the figure.

Next, the running operation of the present refrigeration system will be described below.

Figure 2:
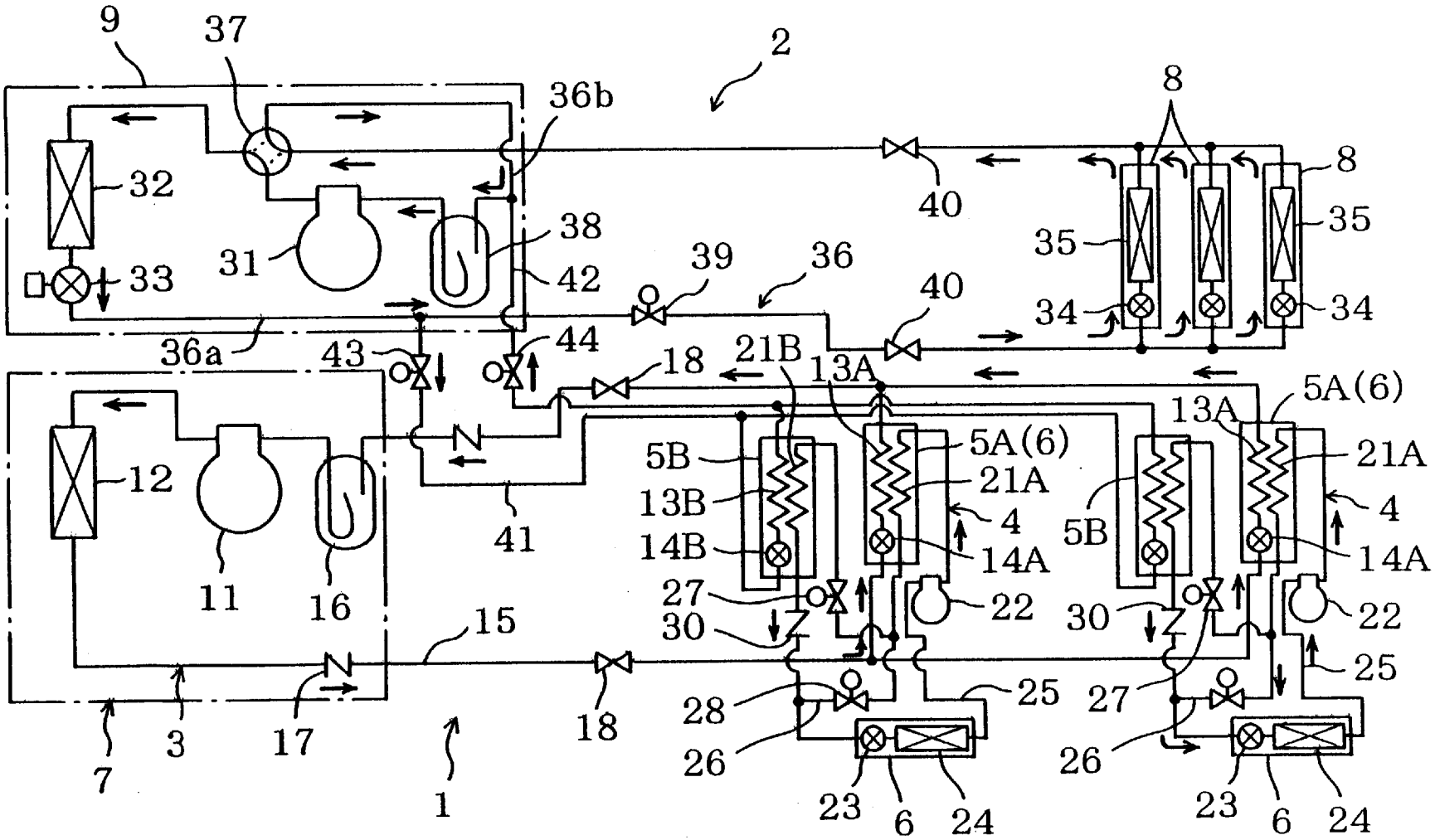
FIG. 2 is a diagram illustrating a first operation state of the refrigeration system of FIG. 1.
Figure 3:
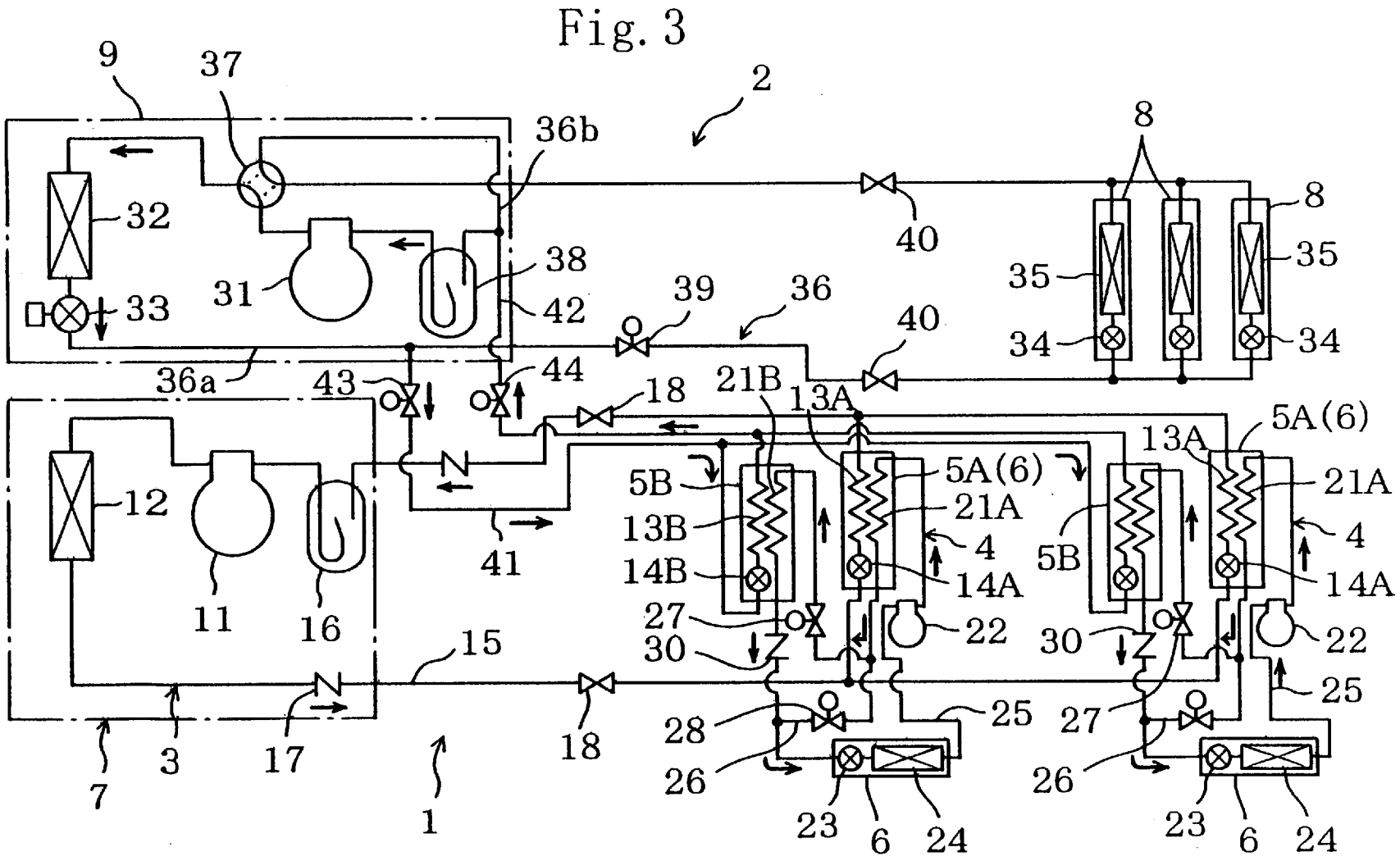
FIG. 3 is a diagram illustrating a second operation state of the refrigeration system of FIG. 1.
Figure 4:
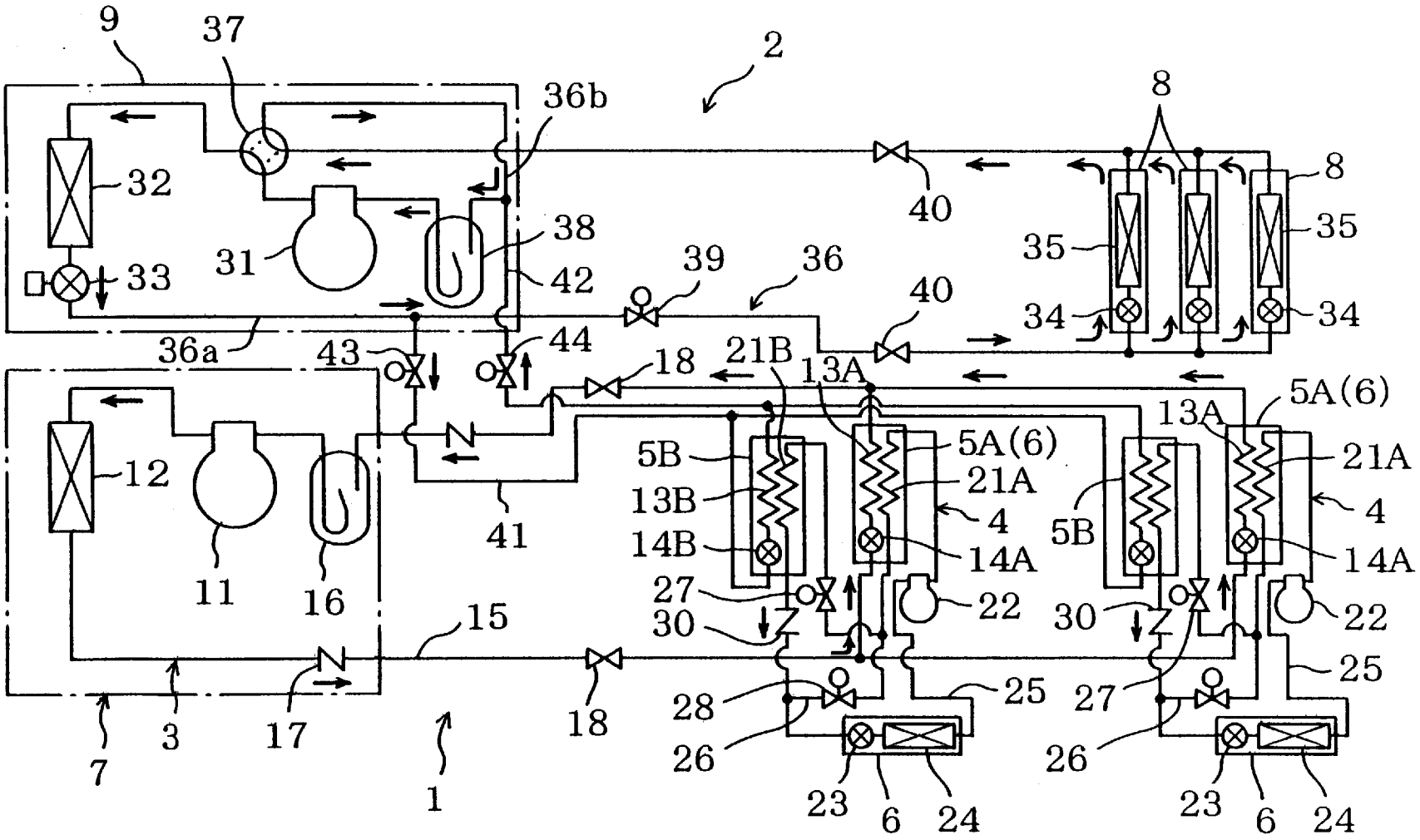
FIG. 4 is a diagram illustrating a third operation state of the refrigeration system of FIG. 1.

Referring to FIGS. 2–4, there are shown states in which the second refrigeration circuit (2) is in a cooling mode of operation. FIG. 2 shows a state in which both the refrigeration circuits (1, 2) operate normally.

At this time, in the second refrigeration circuit (2), the outdoor expansion valve (33) is fully open and the indoor expansion valve (34) is subjected to open control (for example, for the degree of superheat). The solenoid valve (39) is in its open state and both the solenoid valves (43, 44) disposed in the connection piping lines (41, 42) are in their closed state. A high pressure gas refrigerant, discharged from the compressor (31), enters into the outdoor heat exchanger (32) through the four-way selector valve (37). In the outdoor heat exchanger (32), the refrigerant condenses to undergo liquefaction. The resulting liquid refrigerant is decompressed in the indoor expansion valve (34), thereafter cools indoor air at the indoor heat exchanger (35) to evaporate back again to a gas refrigerant, and then returns to the compressor (31). Such a circulation is repeatedly carried out, whereby the room is cooled.

On the other hand, in the first refrigeration circuit (1), if the solenoid valves (27, 28) as the second switching means are placed in the first mode, then refrigerant passes through the bypass passage (26) to circulate between the first refrigerant heat exchanger (5A) and the application-side heat exchanger (24) in each low temperature-side refrigerant circuit (4) while at the same time refrigerant circulates in the high temperature-side refrigerant circuit (3), whereby heat exchange is carried out between the refrigerants of the refrigerant circuits (3, 4) in each refrigerant heat exchanger (5A). In the low temperature-side refrigerant circuit (4), the refrigerant, which has been condensed in the condensation portion (21A) of the refrigerant heat exchanger (5A) to undergo liquefaction, is decompressed in the expansion valve (23), thereafter being evaporated in the application-side heat exchanger (24) to cool air in the showcase (6). In this way, refrigerating operations of two-stage cascade refrigeration cycle are carried out in each showcase (6), whereby foods or the like in each showcase (6) can be preserved at a predetermined low temperature.

On the other hand, if the second switching means (27, 28) are placed in the second mode, then refrigerant circulates in the condensation portions (21A, 21B) of both of the refrigerant heat exchangers (5A, 5B) and the application-side heat exchanger (24) in the low temperature-side refrigerant circuit (4). Because of this, if, while refrigerant is being circulated in the high temperature-side refrigerant circuit (3), refrigerant is supplied also to the second refrigerant heat exchanger (5B) from the second refrigeration circuit (2), then the refrigerants heat-exchange in both the first and second refrigerant heat exchangers (5A, 5B) in the low temperature-side refrigerant circuit (4). This increases the degree of subcool of the refrigerants to temporarily enhance the refrigerating capacity of the refrigeration system. Accordingly, rapid refrigeration can be carried out after defrosting operation without using any equipment with sufficient capacity, which makes it possible to achieve system down-sizing.

Referring to FIG. 3, there is illustrated a running operation when the heat source unit (7) of the first refrigeration circuit (1) stops operating due to failure or the like. At this time, the solenoid valves (43, 44) are placed in their open state and the solenoid valve (39) is placed in its closed state, in order to provide a supply of refrigerant from the compressor (31) of the second refrigeration circuit (2) to the evaporation portion (13B) of each second refrigerant heat exchanger (5B). The closing of the solenoid valve (39) brings the cooling operation to a stop. However, if it is arranged such that refrigerant is allowed to flow towards the indoor unit (8) by not fully closing the solenoid valve (39), this will make it possible to continue the cooling operation although there is a drop in the cooling capacity. Further, the solenoid valves (27, 28) of the low temperature-side refrigerant circuit (4) is switched to enter the second mode, so that refrigerant circulates among the condensation portions (21A, 21B) of both of the refrigerant heat exchangers (5A, 5B) and the application-side heat exchanger (24) in the refrigerant line (25).

In a state as shown in FIG. 3, a gas refrigerant, discharged from the compressor (31) of the second refrigeration circuit (2), changes to a liquid refrigerant in the outdoor heat exchanger (32), thereafter being delivered, by way of the expansion valve (33) in its full open state and the solenoid valve (43), to the evaporation portion (13B) of each second refrigerant heat exchanger (5B). The refrigerant, which has been gasified as a result of heat exchange with a refrigerant of the low temperature-side refrigerant circuit (4) in each second refrigerant heat exchanger (5B), is drawn into the compressor (31) of the second refrigeration circuit (2) by way of the solenoid valve (44) and the accumulator (38) and, then, one cycle has now been completed. Further, in the low temperature-side refrigerant circuit (4), when refrigerant flows, passing through the condensation portion (21B) of the second refrigerant heat exchanger (5B) from the condensation portion (21A) of the first refrigerant heat exchanger (5A), into the application-side heat exchanger (5B), the refrigerant heat-exchanges with a refrigerant of the second refrigeration circuit (2) in the second refrigerant heat exchanger (5B). As a consequence, refrigeration operations of two-stage cascade refrigerating cycle are carried out for the respective showcases (6), whereby the chamber inside of each showcase (6) is maintained at a predetermined temperature.

Next, referring to FIG. 4, there is illustrated a running operation when the compressor (22) of the low temperature-side refrigerant circuit (4) in the first refrigeration circuit (1) stops operating due to failure or the like. At this time, the low temperature-side refrigerant circuit (4) stops. However, if it is arranged such that an air blower for the first refrigerant heat exchanger (5A) operates while refrigerant is being circulated in the high temperature-side refrigerant circuit (3), this causes heat exchange to take place between the refrigerant of the high temperature-side refrigerant circuit (3) and air. As a result, the air is cooled. The air thus cooled is then delivered to the chamber inside. In this case, the operation of the first refrigeration circuit (1) is limited to its high stage side, so that the temperature of the inside of the showcase (6) will somewhat increase; however, it is possible to temporarily prevent the freshness of foods or the like from dropping.

Further, the second refrigerant heat exchanger (5B) may be disposed within the showcase (6), so that, even when in the first refrigeration circuit (1) both the compressor (11) of the high temperature-side refrigerant circuit (3) and the compressor (22) of the low temperature-side refrigerant circuit (4) stop operating, cooled air can be delivered, as in the above, to the chamber inside by operating an air blower for the second refrigerant heat exchanger (5B) while at the same time causing refrigerant to circulate between the compressor (31) of the second refrigeration circuit (2) and the second refrigerant heat exchanger (5B). As a consequence of the forgoing, it becomes possible to temporarily prevent the freshness of foods from dropping.

Figure 5:
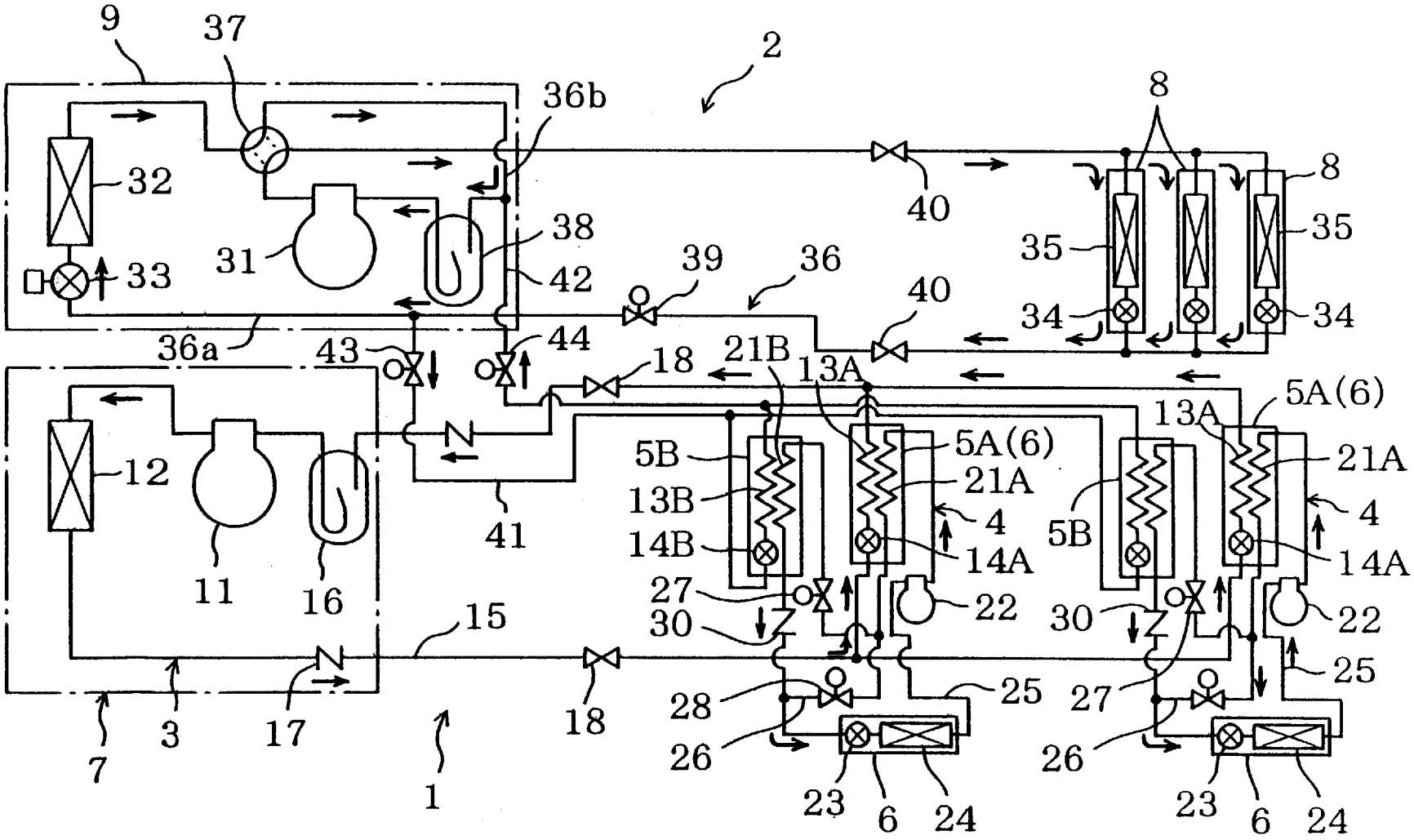
FIG. 5 is a diagram illustrating a fourth operation state of the refrigeration system of FIG. 1.
Figure 6:
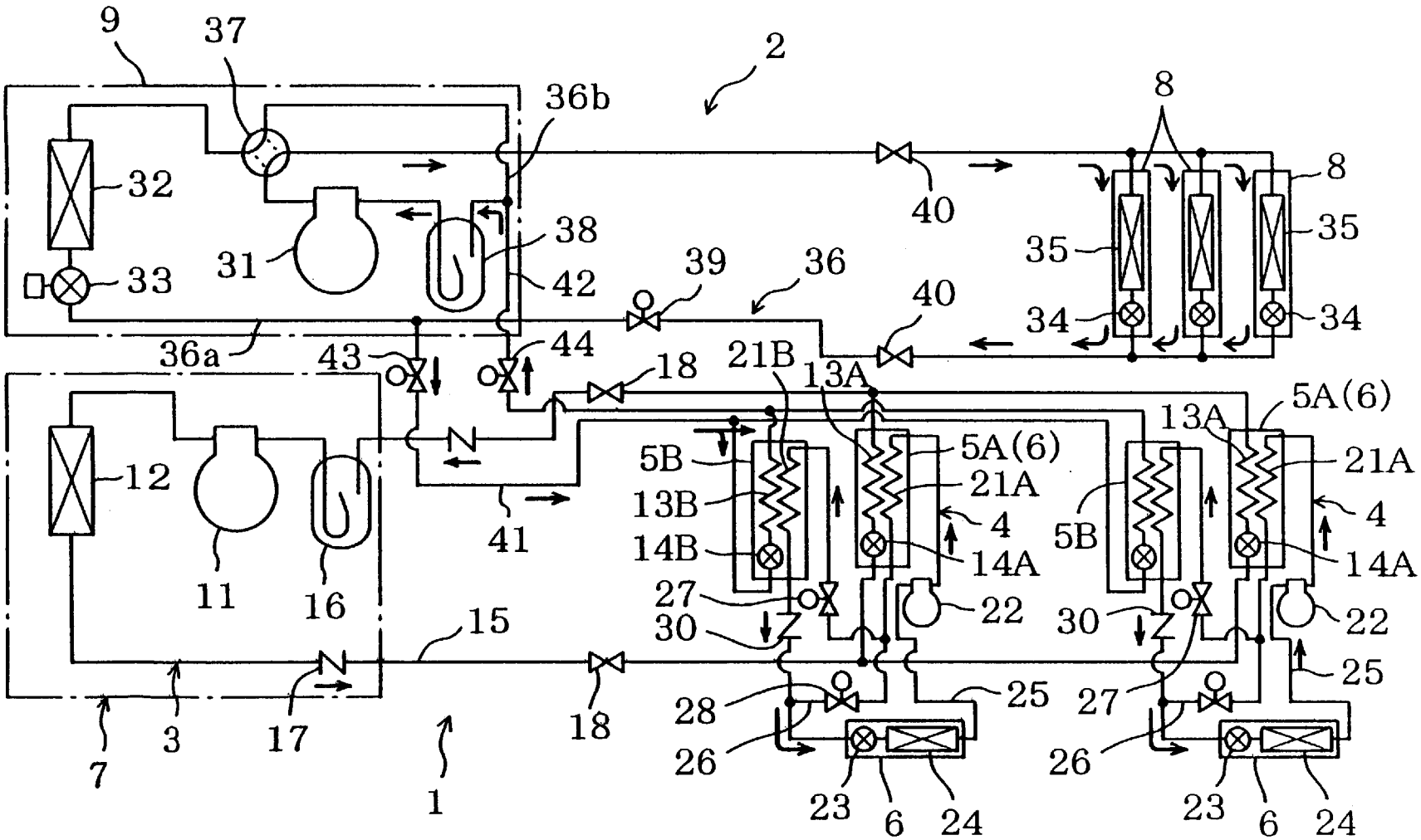
FIG. 6 is a diagram illustrating a fifth operation state of the refrigeration system of FIG. 1.
Figure 7:
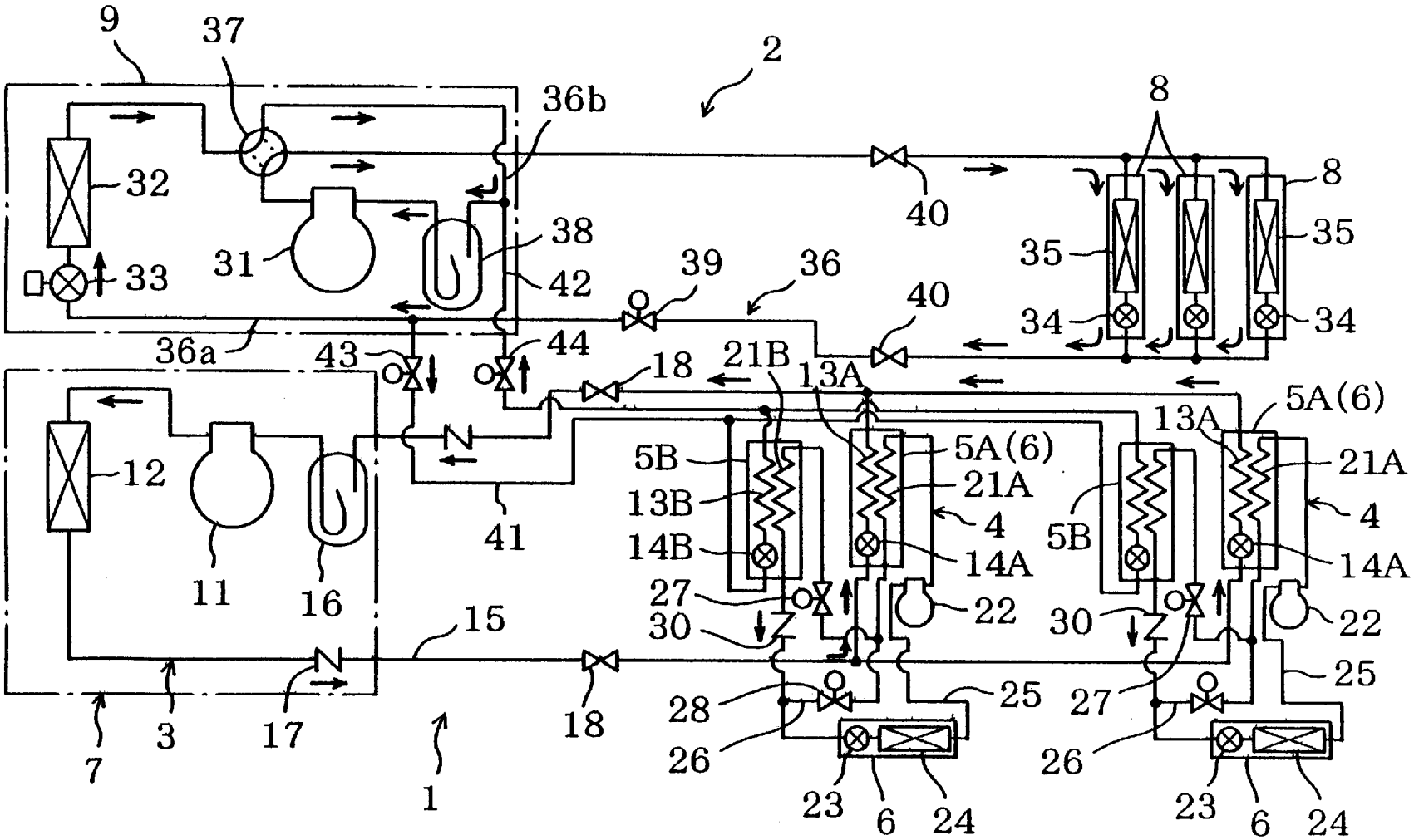
FIG. 7 is a diagram illustrating a sixth operation state of the refrigeration system of FIG. 1.

Referring to FIGS. 5–7, there are shown states in which the second refrigeration circuit (2) is in a heating mode of operation, and FIG. 5 illustrates a state in which both the refrigeration circuits (1, 2) operate normally.

At this time, in the second refrigeration circuit (2) the indoor expansion valve (34) is fully open and the outdoor expansion valve (33) is subjected to open control (for example, for the degree of superheat). Moreover, the solenoid valve (39) is in its open state and, on the other hand, both the solenoid valves (43, 44) disposed in the connection piping lines (41, 42) are in their closed state. A high pressure gas refrigerant, discharged from the compressor (31), enters, by way of the four-way selector valve (37), into the indoor heat exchanger (35) whereat the refrigerant heat-exchanges with indoor air to condense and undergo liquefaction. The resulting heated air is blown into the room to heat it. Meanwhile, the liquid refrigerant, which has left the indoor heat exchanger (35), is decompressed in the outdoor expansion valve (33), thereafter being evaporated in the outdoor heat exchanger (32) to change back again to a gas refrigerant. The gas refrigerant returns to the compressor (31) through the four-way selector valve (37) and the accumulator (38). During the heating operation, the foregoing operation is repeatedly carried out.

Meanwhile, in the first refrigeration circuit (1), as in the cooling mode of operation, refrigerants are circulated in the high temperature-side refrigerant circuit (3) and in each low temperature-side refrigerant circuit (4), wherein in each first refrigerant heat exchanger (5A) heat exchange takes place between the refrigerants of the refrigerant circuits (3, 4). Further, in the low temperature-side refrigerant circuit (4), the solenoid valves (27, 28) as the second switching means are switched to the first mode, as a result of which the refrigerant passes through the bypass passage (26) to circulate between the first refrigerant heat exchanger (5A) and the application-side heat exchanger (24). Accordingly, the refrigerant condenses in the refrigerant heat exchanger (5A) to undergo liquefaction, is decompressed at the expansion valve (23), and is then evaporated in the application-side heat exchanger (24) to cool the air in the showcase (6). In the way described above, two-stage cascade refrigerating cycle operations are carried out for each showcase (6), whereby foods or the like stored in each showcase (6) are maintained at a predetermined low temperature.

As described by making reference to FIG. 2, when rapid refrigeration is required after defrosting operation, in the low temperature-side refrigerant circuit (4) the solenoid valves (27, 28) are set to the second mode so as to cause refrigerant to circulate to both the refrigerant heat exchangers (5A, 5B) and a refrigerant is also supplied from the second refrigeration circuit (2) to the second refrigerant heat exchanger (5B). As a result of such arrangement, it is possible to increase the refrigerating capacity by increasing the degree of subcool of the refrigerant of the low temperature-side refrigerant circuit (4).

Referring to FIG. 6, there is illustrated a running operation when the heat source unit (7) of the first refrigeration circuit (1) stops operating due to failure or the like. A refrigerant of the second refrigeration circuit (2) passes through the indoor heat exchanger (35) to heat indoor air. Thereafter, the refrigerant is delivered, through the solenoid valves (39, 43), to the evaporation portion (13B) of the second refrigerant heat exchanger (5B) for heat exchange with a refrigerant of the low temperature-side refrigerant circuit (4) flowing in the condensation portion (21B) to change to a gas refrigerant. Thereafter, the gas refrigerant passes through the solenoid valve (44) and the accumulator (38) to return back again to the compressor (31) of the second refrigeration circuit (2). During this running operation, the outdoor expansion valve (33) is controlled to enter its fully closed state in order to prevent refrigerant from flowing into the outdoor heat exchanger (32).

At this time, in the low temperature-side refrigerant circuit (4), as is illustrated in FIG. 3, the solenoid valves (27, 28) are switched to the second mode, so that the refrigerant passes through the condensation portions (21A, 21B) of the heat exchangers (5A, 5B) to flow into the application-side heat exchanger (24). Accordingly, two-stage cascade refrigerating-cycle operations are carried out for each showcase (6), whereby each showcase (6) is maintained at a predetermined temperature. Additionally, in this case there is the advantage that it is possible to continuously perform heating operations as well.

In the case there is insufficiency of evaporators in the entire system during this running operation, the open of the outdoor expansion valve (33) can be controlled so as to adjust the balance between evaporator and condenser.

Referring to FIG. 7, there is illustrated a running operation when the compressor (22) of the low temperature-side refrigerant circuit (4) in the first refrigeration circuit (1) stops operating due to failure or the like. At this time, the running operation of the first refrigeration circuit (1) is the same as the one shown in FIG. 4, and by operating an air blower for the first refrigerant heat exchanger (5A) while causing refrigerant to circulate in the high temperature-side refrigerant circuit (3), heat exchange is made to take place between the refrigerant of the high temperature-side refrigerant circuit (3) and air. As a result, the air is cooled and the cooled air is delivered to the chamber inside. Also in this case, as in the example of FIG. 4, the operation of the first refrigeration circuit (1) is limited to its high stage side. Accordingly, although the temperature of the inside of the showcase (6) somewhat increases, it is possible to temporarily prevent the freshness of foods or the like from dropping.

Further, the second refrigerant heat exchanger (5B) may be disposed within the showcase (6), as a result of which arrangement, even when in the first refrigeration circuit (1) both the compressor (11) of the high temperature-side refrigerant circuit (3) and the compressor (22) of the low temperature-side refrigerant circuit (4) stop operating, cooled air can be delivered to the chamber inside by operating an air blower for the second refrigeration heat exchanger (5B) while causing the refrigerant, which has passed through the indoor heat exchanger (35) from the compressor (31) of the second refrigeration circuit (2), to circulate in the second refrigerant heat exchanger (5B). As a consequence of the forgoing, it becomes likewise possible to temporarily prevent the freshness of foods from dropping.

In accordance with the present embodiment, even when, for example, in a convenience store, the compressor (11) of the high temperature-side refrigerant circuit (3) stops operating, it is possible to continuously provide a supply of cooled air to the chamber inside of the showcase (6) by making utilization of the second refrigeration circuit (2) for air conditioning apparatus. This means that the quality of goods can be maintained without having to transfer them into another showcase.

Moreover, even when the compressor (22) of the low temperature-side refrigerant circuit (4) stops operating, it is possible to temporarily prevent the quality of foods or the like from dropping (a) by operating an air blower for the first refrigerant heat exchanger (5A) while causing a refrigerant of the high temperature-side refrigerant circuit (3) to flow in the evaporation portion (13A) of the first refrigerant heat exchanger (5A), (b) by operating an air blower for the second refrigerant heat exchanger (5B) while causing a refrigerant of the second refrigeration circuit (2) to flow in the evaporation portion (13B) of the second refrigerant heat exchanger (5B), or (c) by performing both of (a) and (b) at the same time. Especially, an arrangement capable of performing (a) and (b) at the same time is relatively easy to make for refrigeration apparatus with a sufficient installation space such as a refrigeration warehouse, which is an effective structure for performing temporary operations.

In relatively small stores such as a convenience store, one heat source equipment is generally provided for each refrigerating apparatus, such as the freezing showcase (6A) and a cold storage showcase. Accordingly, when one of the heat source equipment is out of order, then only one of the showcases is available, i.e., only one of the temperature zones is available. For this reason, when the heat source equipment on the refrigeration side is out of order, the stored goods will not be well preserved for a long period of time even when transferred to the cold storage showcase. In accordance with the first embodiment, however, the heat source equipment (31) for air conditioning apparatus is utilized to enable continuation of two-stage cascade refrigerating cycle operation. This therefore enables at least the freezing showcase (6A) to continue its operations, which is effective for the preservation of goods.

With regard to the above-described embodiment, the present invention may be constituted as follows.

For example, in the foregoing embodiment, the second refrigeration circuit (2) is formed into a single-stage refrigerating cycle, which is however not considered to be restrictive. The second refrigeration circuit (2) may be formed into any other cycle (e.g., a two-stage cascade refrigerating cycle) as long as it is a refrigerating cycle different from that of the first refrigeration circuit (1).

Moreover, both the refrigerant heat exchangers (5A, 5B) can be formed integrally using a triple-tube heat exchanger, in which case it may be arranged such that the center is the condensation portions (21A, 21B), the inside is used for the evaporation portion (13B) of the second refrigerant heat exchanger (5B), and the outside is used for the evaporation portion (13A) of the first refrigerant heat exchanger (5A). Moreover, instead of using the triple-tube heat exchanger, a three-fluid plate heat exchanger may be used to integrally form both the refrigerant heat exchangers (5A, 5B). Such integral formation of the two refrigerant heat exchangers reduces the equipment space, therefore facilitating installation to the inside of the showcase (6).

Further, in the running state shown in FIG. 6 (i.e., in the state in which the heat source unit (7) of the high temperature-side refrigerant circuit (3) stops operating in a heating mode of operation), it may be arranged such that the direction in which a refrigerant circulates is reversed to cause the refrigerant to condense in the outdoor heat exchanger (32) during thermo-off operation (a halt of refrigerating operation). Moreover, it is possible to use the outdoor heat exchanger (32) as a condenser by giving up air conditioning during heating operation.

In the foregoing embodiment, in addition to each application-side heat exchanger (24), each first refrigerant heat exchanger (5A) is also disposed in the air passage of the showcase (6). However, depending upon the situation, such a configuration may be employed that the first refrigerant heat exchanger (5A) is located outside the showcase (6) so as not to be served for the cooling of the inside of the showcase (6).

Further, in the foregoing embodiment, the first refrigeration circuit (1) is constructed for the freezing showcase (6). However, in the first refrigeration circuit (1), an arrangement may be made in which there exists a mixture of a cold storage showcase and a so-called boiled-rice showcase for packed lunch, rice ball, and cooked bread. Since these showcases are cold storage apparatus having a temperature zone somewhat higher than that of the freezing showcase (6), a single-stage refrigerating-cycle circuit may be mixed in the first refrigeration circuit (1).

More specifically, in the first refrigeration circuit (1), in order to perform a single-stage refrigerating-cycle by sharing the compressor (11) of the high temperature-side refrigerant circuit (3) and the heat source-side heat exchanger (12), a second application-side heat exchanger (not shown) is connected, in parallel with the refrigerant heat exchanger (5A), to the compressor (11) and the heat source-side heat exchanger (12).

If it is arranged such that refrigerant flows into the second application-side heat exchanger, selectively from the high temperature-side refrigerant circuit (3) of the first refrigeration circuit (1) and from the second refrigeration circuit (2), this allows, even when the heat source unit (7) of the first registration circuit (1) stops operating, not only the freezing showcase (6) but also the cold storage showcase, to continue operating, whereby the foods or the like can be preserved continuously at an adequate temperature.

What is claimed is:

1. A refrigeration system comprising:

a first refrigeration circuit (1) for a refrigerating apparatus (6), said first refrigeration circuit (1) being formed into a two-stage cascade refrigerating cycle by establishing connection between a high temperature-side refrigerant circuit (3) and a low temperature-side refrigerant circuit (4) through a first refrigerant heat exchanger (5A);

a second refrigeration circuit (2) which is formed into a refrigerating cycle different from that of said first refrigeration circuit (1); and a second refrigerant heat exchanger (5B) connected to said low temperature-side refrigerant circuit (4);

wherein said second refrigerant heat exchanger (5B) is connected, through connection piping lines (41, 42), to a liquid piping line (36*a*) and a suction-side gas piping line (36*b*) of said second refrigeration circuit (2) and wherein first switching means (43, 44) are provided for selective circulation of a refrigerant of said second refrigeration circuit (2) to said second refrigerant heat exchanger (5B) through said connection piping lines (41, 42).

2. The refrigeration system of claim 1, wherein said second refrigerant heat exchanger (5B) has a condensation portion (21B) connected serially to a downstream side of a condensation portion (21A) of said first refrigerant heat exchanger (5A);

wherein said low temperature-side refrigerant circuit (4) has a bypass passage (26) so that refrigerant bypasses said second refrigerant heat exchanger (5B) to flow from said first refrigerant heat exchanger (5A) into an application-side heat exchanger (24); and wherein said low temperature-side refrigerant circuit (4) has second switching means (27, 28) for switching between a first mode in which refrigerant passes through said bypass passage (26) to circulate between said condensation portion (21A) of said first refrigerant heat exchanger (5A) and said application-side heat exchanger (24) and a second mode in which said refrigerant circulates among said condensation portions (21A, 21B) of said refrigerant heat exchangers (5A, 5B) and said application-side heat exchanger (24).

3. The refrigeration system of claim 1, wherein said second refrigeration circuit (2) is a refrigeration circuit for air conditioning apparatus.

4. The refrigeration system of claim 1, wherein said first refrigerant heat exchanger (5A) is able to provide a supply of air to the chamber inside of said refrigerating apparatus (6) by means of an air blower.

5. The refrigeration system of either claim 1 or claim 4, wherein said second refrigerant heat exchanger (5B) is able to provide a supply of air to the chamber inside of said refrigerating apparatus (6) by means of an air blower.

6. The refrigeration system of claim 1, wherein said second refrigeration circuit (2) is formed into a single-stage refrigerating cycle.

* * * * *